US008968118B2

(12) United States Patent
Black, Jr. et al.

(10) Patent No.: US 8,968,118 B2
(45) Date of Patent: Mar. 3, 2015

(54) GOLF TEEING DEVICE

(71) Applicants: John Luther Black, Jr., Costa Mesa, CA (US); John Efrin Candias, Newport Beach, CA (US)

(72) Inventors: John Luther Black, Jr., Costa Mesa, CA (US); John Efrin Candias, Newport Beach, CA (US)

(73) Assignee: Tee-Claw LLC, Tustin, CA (US)

( * ) Notice: Subject to any disclaimer, the term of this patent is extended or adjusted under 35 U.S.C. 154(b) by 50 days.

(21) Appl. No.: 13/918,027

(22) Filed: Jun. 14, 2013

(65) Prior Publication Data

US 2014/0371006 A1 Dec. 18, 2014

(51) Int. Cl.
*A63B 57/00* (2006.01)

(52) U.S. Cl.
CPC ..... *A63B 57/0018* (2013.01)
USPC ..... 473/387; 473/386

(58) Field of Classification Search
USPC ..... 473/387–403, 386; D21/717, 718; 24/457, 296, 297; 411/438, 439, 457; 16/4
See application file for complete search history.

(56) References Cited

U.S. PATENT DOCUMENTS

| | | | | | |
|---|---|---|---|---|---|
| 1,413,496 | A * | 4/1922 | Sibbald | 473/398 |
| 1,936,625 | A * | 11/1933 | Goldman | 473/398 |
| 3,406,977 | A * | 10/1968 | Voelkerding | 473/398 |
| 5,085,431 | A * | 2/1992 | McGuire | 473/386 |
| 5,156,403 | A | 10/1992 | Martino | |
| D349,318 | S | 8/1994 | Rubin | |
| 5,658,110 | A * | 8/1997 | Kraus | 411/510 |
| 5,766,100 | A * | 6/1998 | Dilmore | 473/396 |
| 5,967,909 | A * | 10/1999 | Broadbridge | 473/386 |
| 6,024,654 | A * | 2/2000 | Chun | 473/386 |
| 6,062,989 | A | 5/2000 | Wagner | |
| 6,735,819 | B2 * | 5/2004 | Iverson et al. | 16/4 |
| 6,746,340 | B1 | 6/2004 | Dover | |
| 7,303,493 | B1 | 12/2007 | Ehresman | |
| 7,846,044 | B2 * | 12/2010 | Sagadevan | 473/396 |
| 8,622,853 | B1 * | 1/2014 | Roland | 473/398 |
| 2004/0132554 | A1 | 7/2004 | Schulze | |
| 2004/0185967 | A1 * | 9/2004 | McDonough et al. | 473/387 |
| 2005/0277489 | A1 * | 12/2005 | Choe | 473/396 |
| 2006/0035728 | A1 * | 2/2006 | Chang | 473/387 |

(Continued)

FOREIGN PATENT DOCUMENTS

| | | | |
|---|---|---|---|
| AU | 2003-282236 | A1 | 6/2004 |
| AU | 2003-303514 | A1 | 7/2004 |

(Continued)

OTHER PUBLICATIONS

Kim, Seung Beom, Patent Cooperation Treaty International Search Report & Written Opinion of the International Search Authority, Oct. 10, 2014, ISA, Korea.

(Continued)

*Primary Examiner* — Steven Wong
(74) *Attorney, Agent, or Firm* — Marc E. Hankin; Hankin Patent Law, APC; Kevin Schraven

(57) ABSTRACT

A golf teeing device. The golf teeing device preferably engages with a surface, such as an artificial golf mat, such that the user may conveniently place a golf ball to be hit. The golf teeing device is preferably comprised of a base and a top, wherein the base has extensions or hooks that extend in a substantially downward and sideways manner. These hooks, when rotated, grip into the artificial golf mat and hold the invention in place on the mat. The top of the golf teeing device is configured to engage with a golf ball and/or golf tee.

20 Claims, 8 Drawing Sheets

(56) References Cited

U.S. PATENT DOCUMENTS

| | | | | |
|---|---|---|---|---|
| 2006/0058120 | A1* | 3/2006 | Anton | 473/386 |
| 2006/0079350 | A1* | 4/2006 | Lu et al. | 473/387 |
| 2006/0105859 | A1 | 5/2006 | Thirkettle et al. | |
| 2007/0167259 | A1 | 7/2007 | Lipidarov | |
| 2007/0202966 | A1* | 8/2007 | Lipidarov | 473/387 |
| 2008/0102988 | A1* | 5/2008 | Sagadevan | 473/397 |
| 2008/0146383 | A1* | 6/2008 | Dandelius | 473/397 |
| 2009/0137345 | A1* | 5/2009 | Sagadevan | 473/396 |
| 2010/0075782 | A1* | 3/2010 | Stiles | 473/386 |
| 2012/0214616 | A1 | 8/2012 | Lipstock et al. | |
| 2014/0090233 | A1* | 4/2014 | Kochheiser et al. | 29/525.11 |

FOREIGN PATENT DOCUMENTS

| | | | |
|---|---|---|---|
| CA | 2263700 | A1 | 10/1999 |
| CA | 2263700 | C | 5/2001 |
| EP | 1812127 | A1 | 8/2007 |
| GB | 0226470 | | 12/2002 |
| GB | 0509322 | | 6/2005 |
| GB | 2409821 | A | 7/2005 |
| GB | 2409821 | B | 2/2006 |
| SE | 0402837 | | 11/2004 |
| WO | 2004043551 | A1 | 5/2004 |
| WO | 2004-060501 | A1 | 7/2004 |
| WO | 2006-054948 | A1 | 5/2006 |
| WO | 2010-033831 | A2 | 3/2010 |
| WO | 2010-033831 | A3 | 6/2010 |

OTHER PUBLICATIONS

Shenzhen Ajd Enterprise Co., Ltd.; 4 of set winter golf tees (size:12 17 22 37mm), rubber golf tee, golf tee, golf accessory; lulusoso.com; Mar. 12, 2012; 5 pages; China; http://sell.lulusoso.com/selling-leads/714661/4-of-set-winter-golf-tees-size-12-17-22-37mm-rubber-golf-tee-golf-tee-golf-accessory.html.

Sklz Training Center; Brush Tee Replacement; 2 pages; http://www.sklz.com/sports-training/parts/baseballsoftball/fastpitch-brush-tee-replacement?gclid=CP_k0o-dl7cCFQVV4Aodh1lAsA, submitted Jun. 14, 2013.

* cited by examiner

GOLF TEEING DEVICE

FIELD OF THE INVENTION

The invention generally relates to golf tees, golf tee holders, golf teeing devices, and methods thereof. More specifically, the invention relates to devices that rotatably engage with a surface, such as an artificial grass golf mat, or that act as a golf tee.

BACKGROUND OF THE INVENTION

The modern game of golf originated in Scotland in the 15th century. Since its inception, the game of golf has globally risen in popularity. Whether golf is played for the purpose of exercising, passing time outdoors, providing an outlet to escape the day-to-day strains and worries, building social and business contacts, spending time with loved ones, or just enjoying the challenge of the sport itself, golf has generally transformed into a highly desirable sport for a diverse population of golfers of all levels and with different golfing preferences.

Although an increasing number of golfers are picking up the sport, driving ranges that provide golfers with a place to practice are generally ill-equipped to accommodate the various levels and preferences of the players. Many driving ranges are generally equipped with artificial grass mats that can pose many challenges to golfers. These artificial grass mats may cause golfers to either: (1) hit directly on the surface of the artificial grass mat, thereby causing the golfer to alter his or her golf swing, or (2) hit on a bulky rubber tee that is inserted through a hole in the artificial grass mat. The bulky rubber tee is generally not adjustable and typically requires the user to lift the dirty mat, brave all of the bugs that live under the mat, and push the rubber tee upward through the hole.

In addition to its difficulty in installation and removal, the standard and bulky rubber tee typically has many other deficiencies. One deficiency is typically the low predictability of the golf ball trajectories when golf balls are hit from the standard rubber tee. This deficiency is usually exacerbated by the fact that the predictability is even lower when hitting golf balls directly from the mat surface itself.

Another deficiency is generally the set placement of a rubber tee on one of the sides of the artificial grass mat, a fixed position which does not accommodate both right- and left-handed golfers, many of whom would prefer to place the ball elsewhere on the mat while retaining the ability to strike the ball from a raised height. Furthermore, another deficiency is that the rubber tee itself does not accommodate varying the height of the ball as the ball rests on the tee.

To address these issues, there have been dozens, if not hundreds, of devices to remedy the deficiencies of the standard bulky rubber tee. U.S. Patent Application Publication Number 2008/0146383, filed by Dandelius, discloses a golf tee device that fits into the hole of a golf mat from the top and generally supports a golf tee. Although the Dandelius device does allow the user to forego having to lift the golf mat, the Dandelius device has its own deficiencies, including being very complex, being expensive to manufacture, and having two separate parts. Moreover, the Dandelius device generally is limited to being placed only in the standard hole that was already in the golf mat to accommodate the bulky rubber tee, and generally cannot engage the mat in any other location. Finally, the Dandelius device generally does not allow the user to engage the use of a standard wooden tee or vary the height of the ball placement.

U.S. Patent Application Publication Number 2007/0167259, filed by Lipidarov, discloses a golf tee device that is more flexible than the Dandelius device. Unfortunately, the Lipidarov golf tee device is even more complex and still requires the user to use the existing hole in the golf mat.

U.S. Patent Application Publication Number 2004/0132554, filed by Schulze, discloses a golf tee holder that engages with a standard wooden tee. The Schulze golf tee holder, however, still must be placed under an artificial grass mat.

Thus, what is needed is a reusable, easy-to-use, inexpensive golf tee that securely grips on to a golfing surface, including an artificial grass mat, at any location on the mat, and that can easily be removed from the surface.

SUMMARY OF THE INVENTION

To minimize the limitations in the prior art, the present carrying device discloses a new and useful golf tee and golf tee holder device.

One embodiment of the invention is a golf teeing device comprising: a top portion; and a base portion, wherein the base portion is comprised of one or more extensions. The extensions are configured to removably and securely engage with a surface. The top portion is configured to cradle a golf ball. The golf teeing device may also include a standard tee engagement portion, wherein the standard tee engagement portion is configured to matingly engage with a standard tee, such that the standard tee cradles a golf ball. The standard tee engagement portion is a hole, wherein an edge of the hole is configured to matingly engage with the standard tee such that the standard tee cradles the golf ball. Preferably, the one or more extensions extend substantially downward and substantially horizontally. Preferably, the one or more extensions engage with the surface by rotating the golf teeing device as the one or more extensions are in contact with the surface. Preferably, the one or more extensions are comprised of one or more serrated edges. Preferably, the surface is a golf mat. Preferably, the hole is configured to matingly engage with a standard tee, such that a height of the standard tee is adjustable. Preferably, the top portion is comprised of a soft plastic material and the base portion is comprised of a hard plastic material. Preferably, there are four or six extensions.

Another embodiment of the invention is a golf teeing device comprising: a top portion; a base portion; and a hole. The hole extends substantially through the top portion and the base portion. The hole is comprised of a raised lip edge on the top portion. The base portion is comprised of one or more extensions, which are configured to removably and securely engage with a surface. The raised lip edge is configured to cradle a golf ball. Preferably, the hole is configured to matingly engage with the standard tee, such that the standard tee cradles the golf ball. Preferably, the one or more extensions are on an outer rim of the base portion and wherein the one or more extensions extend substantially downward and substantially horizontally from the base portion. Preferably, the one or more extensions engage with the surface by rotating the golf teeing device as the one or more extensions are in contact with the surface. Preferably, the one or more extensions are comprised of one or more serrated edges. Preferably, the surface is a golf mat. Preferably, the hole is configured to matingly engage with a standard tee such that a height of the standard tee, as it rests in the hole, is adjustable. Preferably, the top portion is comprised of a soft plastic material and the base portion is comprised of a hard plastic material. Preferably, the base portion is comprised of four or more extensions.

The invention is preferably a golf tee, golf tee holder, and golf teeing device that slides or grips onto the ground or a surface, such as a golf mat. This generally allows the user to use the device as a tee or to use it to hold a standard golf tee. The standard golf tee, which is typically wood or plastic, generally slides into a hole in the middle of the teeing device and is typically held in place as a user tees a ball on the standard tee so that the ball can be struck.

It is an object of the invention to claw, slide, and/or grip into a surface, such as an artificial grass golf mat, such that the golf teeing device may be secured, removably, to the surface while the user hits golf balls. The extensions generally project downward and horizontally (parallel to the base of the device), to allow the extensions to slide sideways into the surface.

It is another object of the invention to provide a golf teeing device that has the ability to hold various types and sizes of standard golf tees at different tee heights.

It is another object of the invention to eliminate the need to lift a golf mat to engage a tee device with the golf mat.

It is another object of the invention to provide the freedom for tee placement anywhere on the golf mat, convenient for all golfers, left- and right-handed alike.

It is another object of the invention to offer a durable, reusable, affordable golf teeing device that securely, but removably, engages with the surface and acts as both a tee and tee holder. The invention is preferably made of hard plastic or metal on a base to keep the device firmly in the ground. The hole and top portion is preferably made from a soft plastic, such as plastic foam, such that the top portion is strong enough to withstand a direct hit from a golf club, but soft enough to not damage the golf club.

It is another object of the invention to overcome the deficiencies of the prior art.

These, as well as other components, steps, features, objects, benefits, and advantages, will now become clear from a review of the following detailed description of illustrative embodiments, of the accompanying drawings, and of the claims.

BRIEF DESCRIPTION OF THE DRAWINGS

The drawings are of illustrative embodiments, but do not depict all embodiments. Other embodiments may be used in addition to or instead of the illustrative embodiments. Details that may be apparent or unnecessary may be omitted for the purpose of saving space or for more effective illustrations. Some embodiments may be practiced with additional components or steps and/or without some or all components or steps provided in the illustrations. When different drawings contain the same numeral, that numeral refers to the same or similar components or steps.

DETAILED DESCRIPTION OF THE DRAWINGS

In the following detailed description of various embodiments of the invention, numerous specific details are set forth in order to provide a thorough understanding of various aspects of one or more embodiments of the invention. However, one or more embodiments of the invention may be practiced without some or all of these specific details. In other instances, well-known procedures and/or components have not been described in detail so as not to unnecessarily obscure aspects of embodiments of the invention.

While some embodiments are disclosed here, still other embodiments of the present invention will become obvious to those skilled in the art as a result of the following detailed description of embodiments of the invention. The invention is capable of modifications of various obvious aspects, all without departing from the spirit and scope of the present invention. The Figures, and their detailed descriptions, are to be regarded as illustrative in nature and not restrictive. Also, the reference or non-reference to a particular embodiment of the invention shall not be interpreted to limit the scope of the invention.

Figure 1:
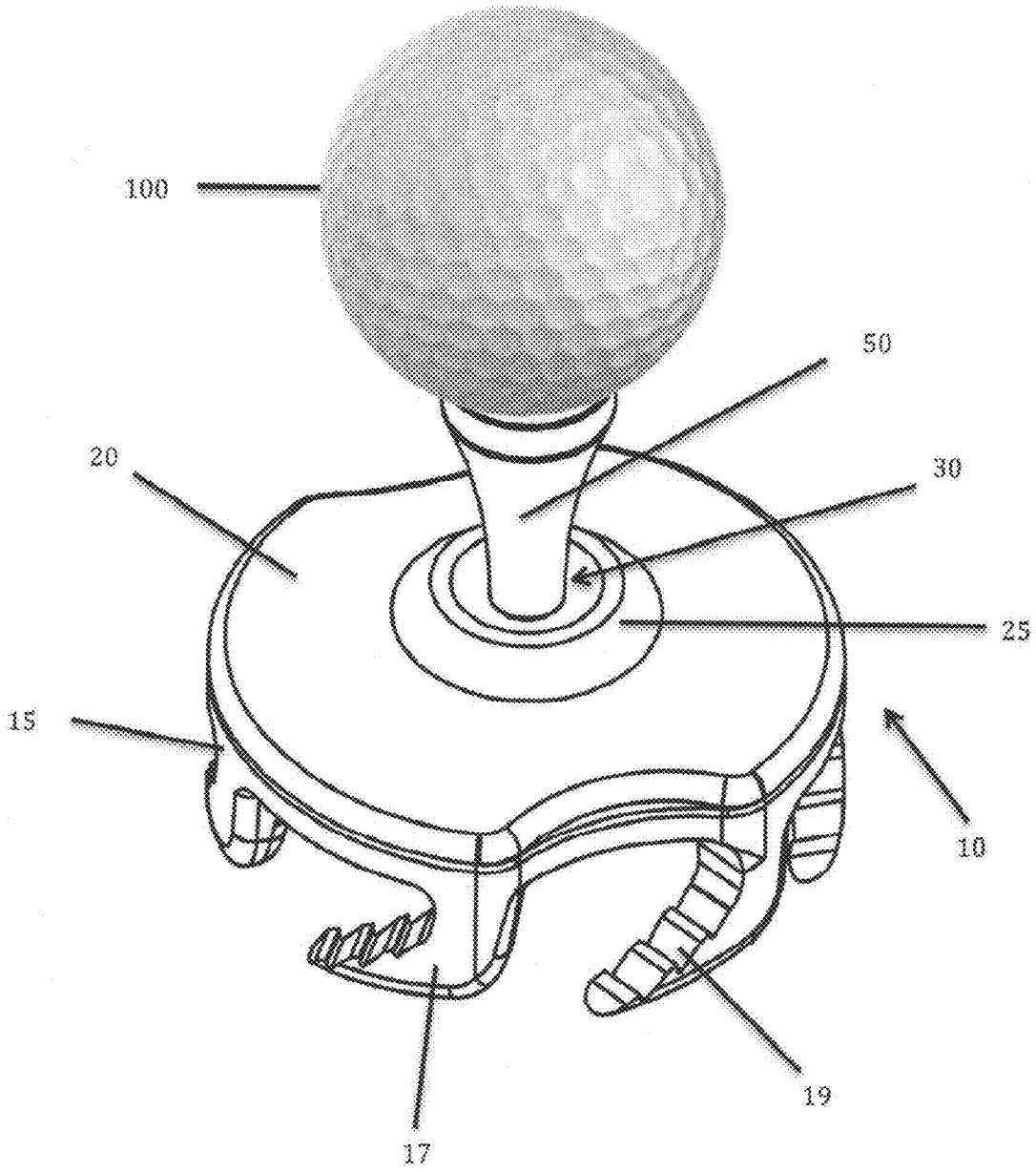
FIG. 1 is an illustration of a perspective view of one embodiment of the golf teeing device and shows the golf teeing device holding a standard golf tee and golf ball.

FIG. 1 is an illustration of a perspective view of one embodiment of the golf teeing device and shows the golf teeing device holding a standard golf tee and golf ball. As shown in FIG. 1, the golf teeing device 10 may be comprised of a base portion 15, top portion 20, hole 30, golf ball engagement portion 25, also referred to as a rim, edge, or raised lip edge, and one or more extensions 17. FIG. 1 shows the golf teeing device 10 to have preferably more than one extension. The extensions 17 preferably are pointed protrusions, arms, or claws that are configured to slice, dig, or grip into a surface, such as an artificial grass golf mat. The extensions 17 also preferably have at least one serrated edge 19 to better grip into the golf mat or ground. It should be understood that, depending on the surface onto which the device 10 will be connected, the golf teeing device 10 may have any number of extensions 17 without deviating from the scope of the invention. The extensions 17 preferably extend downward and horizontally, such that the extensions 17 are substantially parallel with the base 15 and top portion 20. This generally allows the extensions 17 to engage with the golf mat by twisting or rotating the golf teeing device 10 while pushing down on the golf teeing device 10 by a user. FIG. 1 also shows that the extensions 17 are preferably configured to be rotated clockwise to engage with the mat, ground, or surface and counterclockwise to remove the device 10 from the mat, ground, or surface.

Preferably the base portion 15 and extensions 17 are made from a hard plastic or some other durable material, such as metal, but it should be understood that the extensions 17 may be made from any material that is durable. Preferably, the material allows the device 10 to be engaged securely to a surface, such as an artificial grass mat. Preferably, the top portion 20 and the raised lip 25 are made from a soft plastic material, such as rubber, foam rubber, or foam plastic, but may be made from any durable material that minimizes the damage to a golf club when in contact during a swing. Alternatively, raised lip 25 may be a separate insert that runs through both the top portion 20 and base portion 15.

FIG. 1 also shows how the hole 30, which is preferably in the center, or substantially in the center, of the golf teeing device 10, is configured to engage a standard golf tee 50. Because the hole 30 is preferably made from a soft plastic material, the hole 30 releasably secures and/or engages the tee 50 at various points along the length of the tee 50. This generally allows the user to vary the height of the tee 50 as it is held by the golf teeing device 10. Furthermore, this configuration generally allows the user to use broken tees with the device 10, which preferably extends the life of many tees that would otherwise be discarded. Although a standard wooden or plastic golf tee is shown in FIG. 1, it should be understood that various tees may be used. FIG. 1 also shows how the tee 50 is used to hold a golf ball 100. Because the height of the tee 50 is adjustable, the height of the golf ball 100 is also adjustable.

Figure 2:
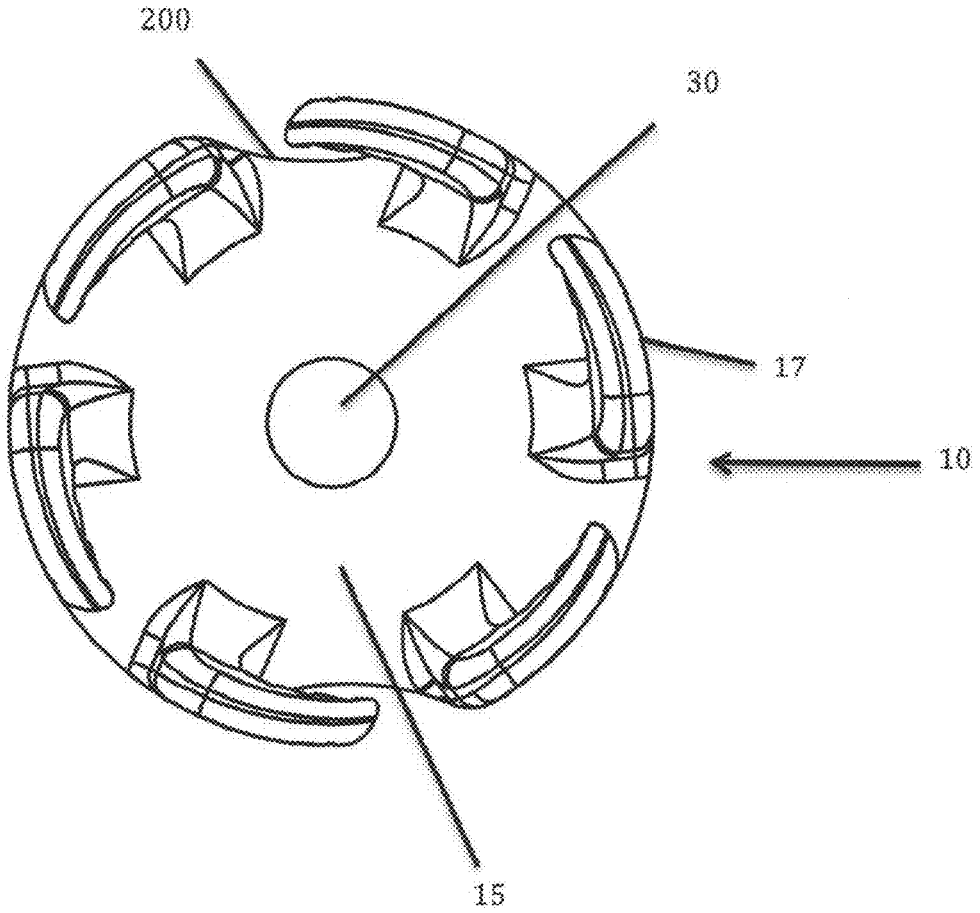
FIG. 2 is an illustration of a bottom view of one embodiment of the golf teeing device.

FIG. 2 is an illustration of a bottom view of one embodiment of the golf teeing device. As shown in FIG. 2, the golf teeing device 10 preferably includes the base portion 15, extensions 17, and hole 30. As shown in FIG. 2, the device 10 preferably is substantially circular and includes one or more grip notches 200. The grip notches 200 generally allow the user to easily twist the golf teeing device into the golf mat or surface. FIG. 2 also shows how the extensions 17 are curved to match the circular curve of the device 10. This generally allows the device 10 to more uniformly, securely, and easily twist into the surface. Furthermore, FIG. 2 also shows how the hole 30 preferably extends through the entire width of the device 10 to allow the tee 50 to be secured by the hole 30.

Figure 3:
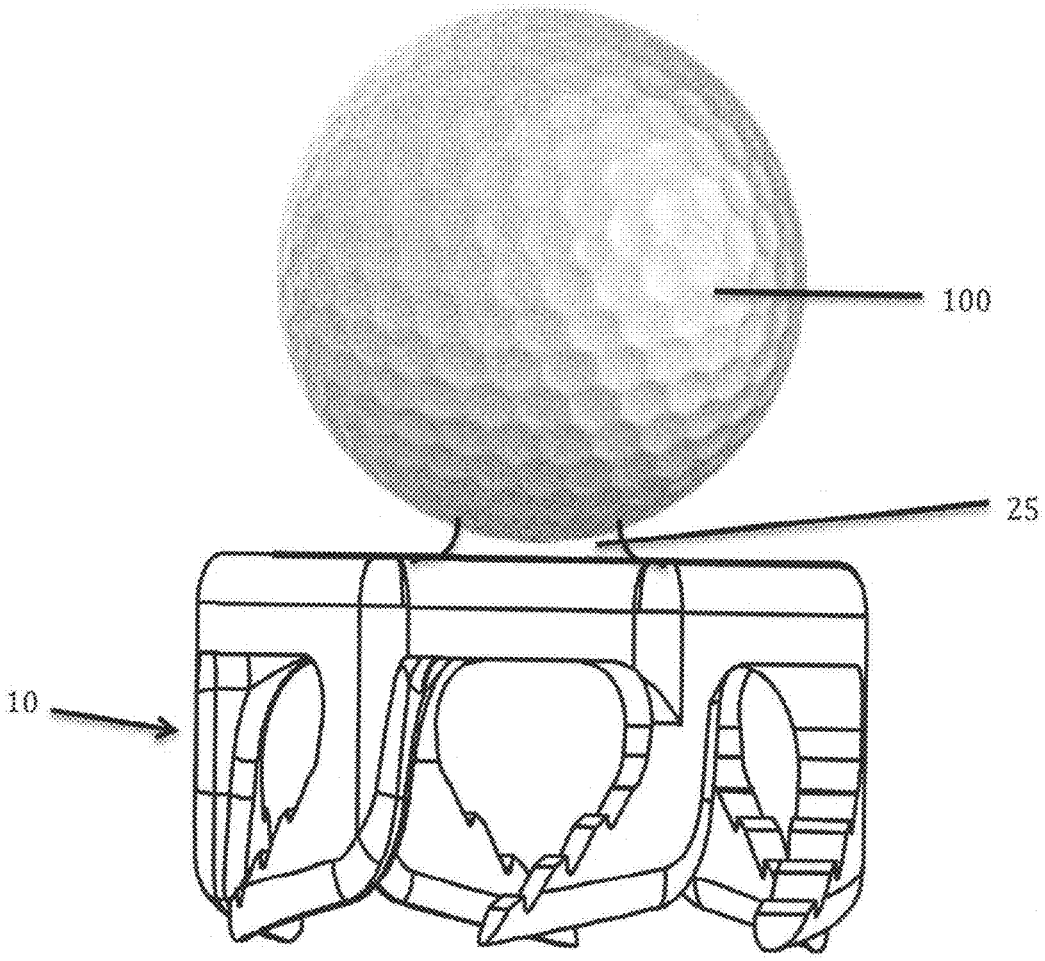
FIG. 3 is an illustration of the side view of another embodiment of the golf teeing device and shows the golf teeing device directly holding a golf ball.

FIG. 3 is an illustration of the side view of another embodiment of the golf teeing device and shows the golf teeing device directly holding a golf ball. As shown in FIG. 3, the golf teeing device 10 is preferably configured to cradle a golf ball 100. Specifically, the golf ball is generally cradled by a golf ball engagement portion 25, which may be the raised lip edge 25 of hole 30. After the golf teeing device 10 is engaged with a surface, the user may place a golf ball 100 on the golf ball engagement portion 25 and then swing at the ball using a golf club.

Figure 4:
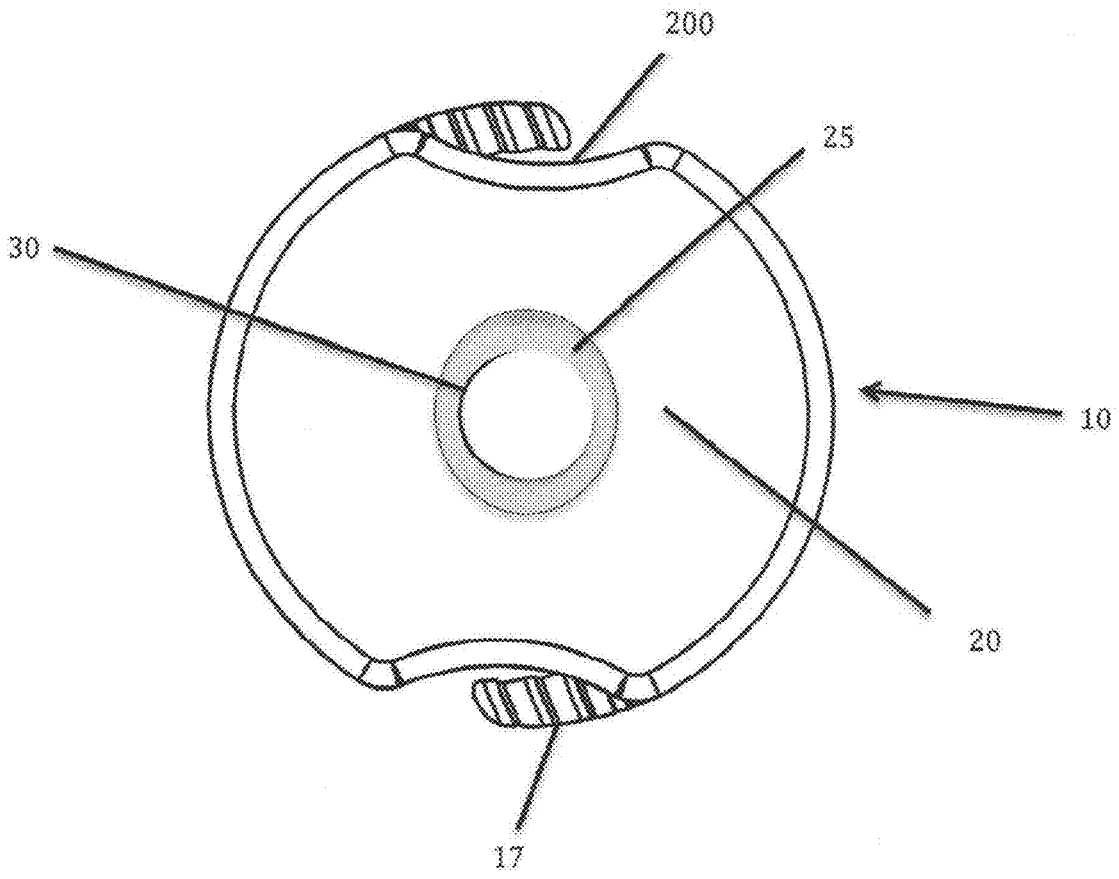
FIG. 4 is an illustration of the top view of one embodiment of the golf teeing device.

FIG. 4 is an illustration of the top view of one embodiment of the golf teeing device. As shown in FIG. 4, the golf teeing device 10 preferably includes top portion 20, hole 30, raised lip edge 25, extension 17, and grip notches 200.

Figure 5:
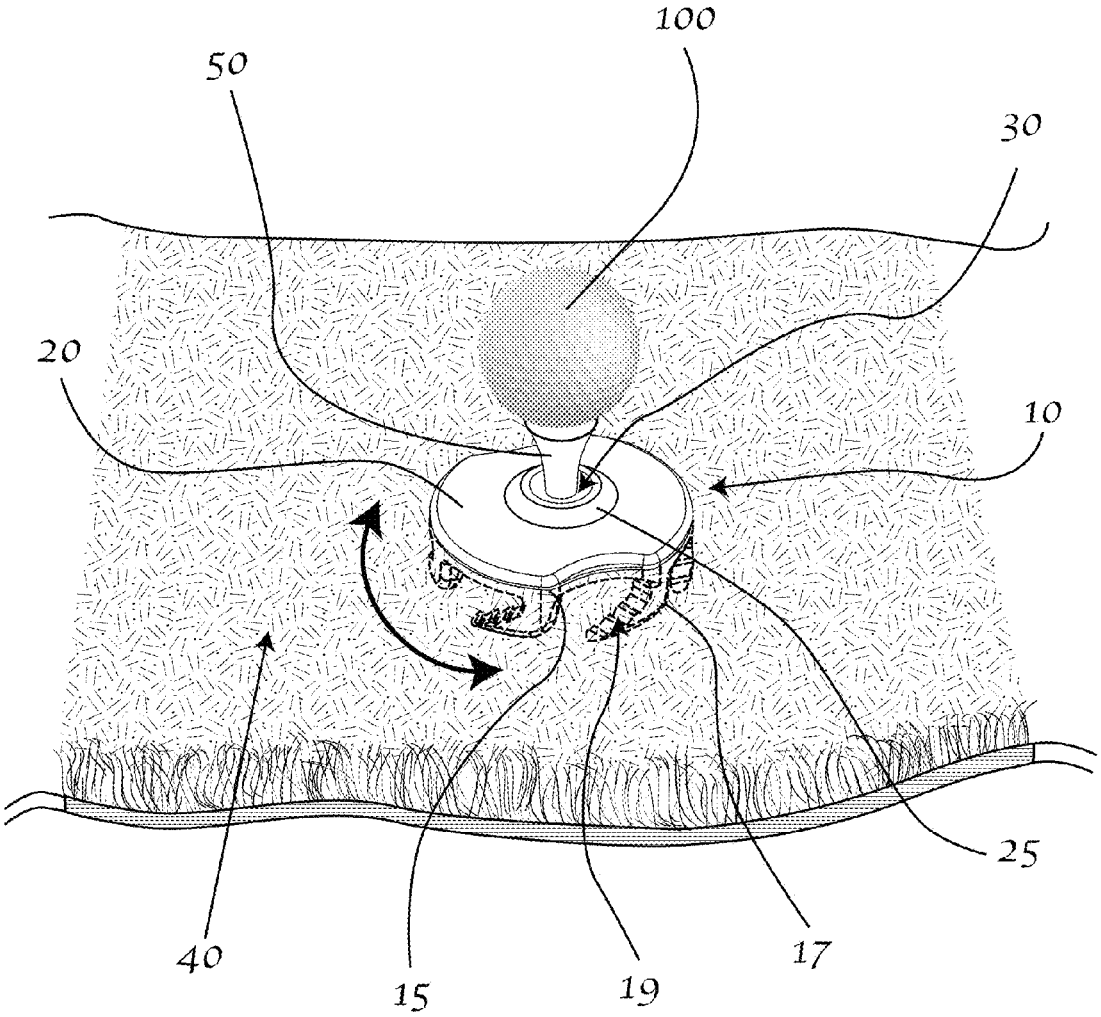
FIG. 5 is an illustration of a perspective view of one embodiment of the golf teeing device and shows the golf teeing device twisted into a surface and holding a standard golf tee and golf ball.

FIG. 5 is an illustration of a perspective view of one embodiment of the golf teeing device and shows the golf teeing device twisted into a surface and holding a standard golf tee and golf ball. As shown in FIG. 5, the golf teeing device 10 may be comprised of a base portion 15, top portion 20, hole 30, golf ball engagement portion 25, and extensions 17. The extensions 17 preferably have at least one serrated edge 19 to better grip into a surface, such as an artificial grass golf mat 40. FIG. 5 shows the extensions 17 preferably engage with the golf mat 40 by twisting or rotating the golf teeing device 10. FIG. 5 shows that the golf teeing device 10 and extensions 17 are preferably configured to be rotated clockwise to engage with the mat 40, ground, or surface, and counterclockwise to remove the golf teeing device 10 from the mat 40, ground, or surface. FIG. 5 also shows how the hole 30 is configured to engage a standard golf tee 50, which is used to hold a golf ball 100.

Figure 6:
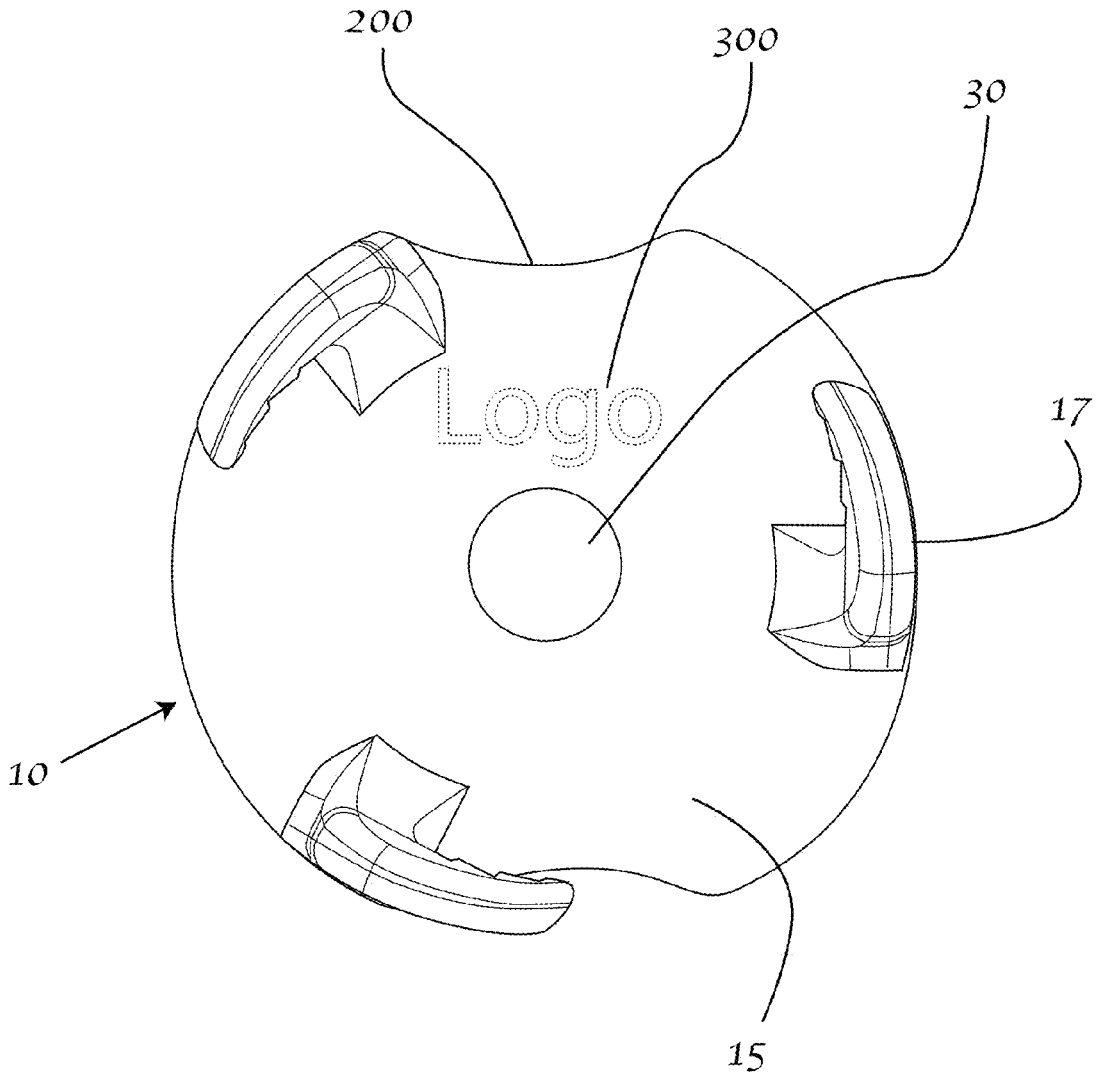
FIG. 6 is an illustration of a bottom view of another embodiment of the golf teeing device.

FIG. 6 is an illustration of a bottom view of another embodiment of the golf teeing device, showing three extensions. As shown in FIG. 6, the golf teeing device 10 preferably includes the base portion 15, extensions 17, grip notches 200, hole 30, and brand 300.

Figure 7:
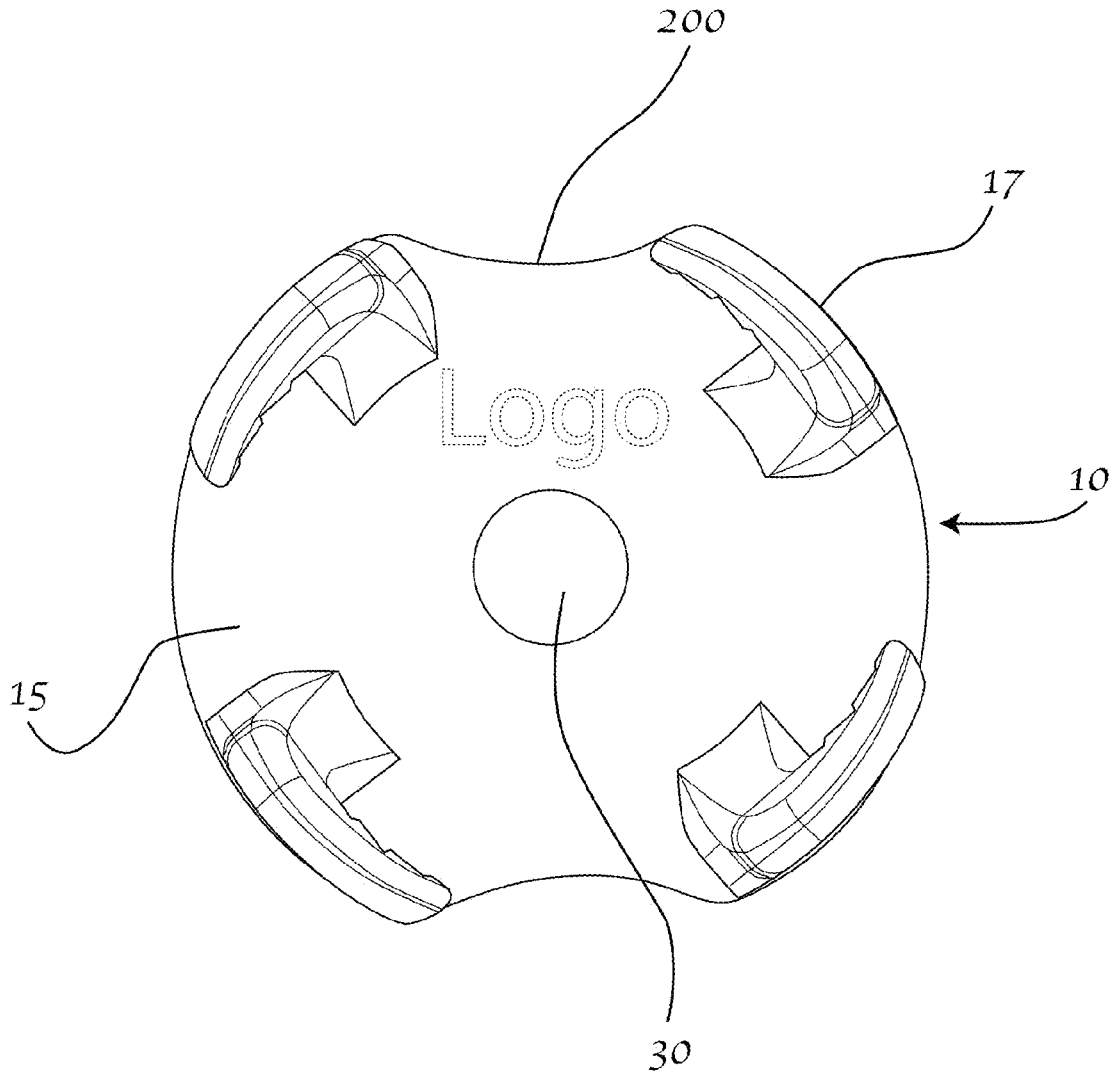
FIG. 7 is an illustration of a bottom view of another embodiment of the golf teeing device.

FIG. 7 is an illustration of a bottom view of another embodiment of the golf teeing device, showing four extensions. As shown in FIG. 7, the golf teeing device 10 preferably includes the base portion 15, extensions 17, grip notches 200, and hole 30.

Figure 8:
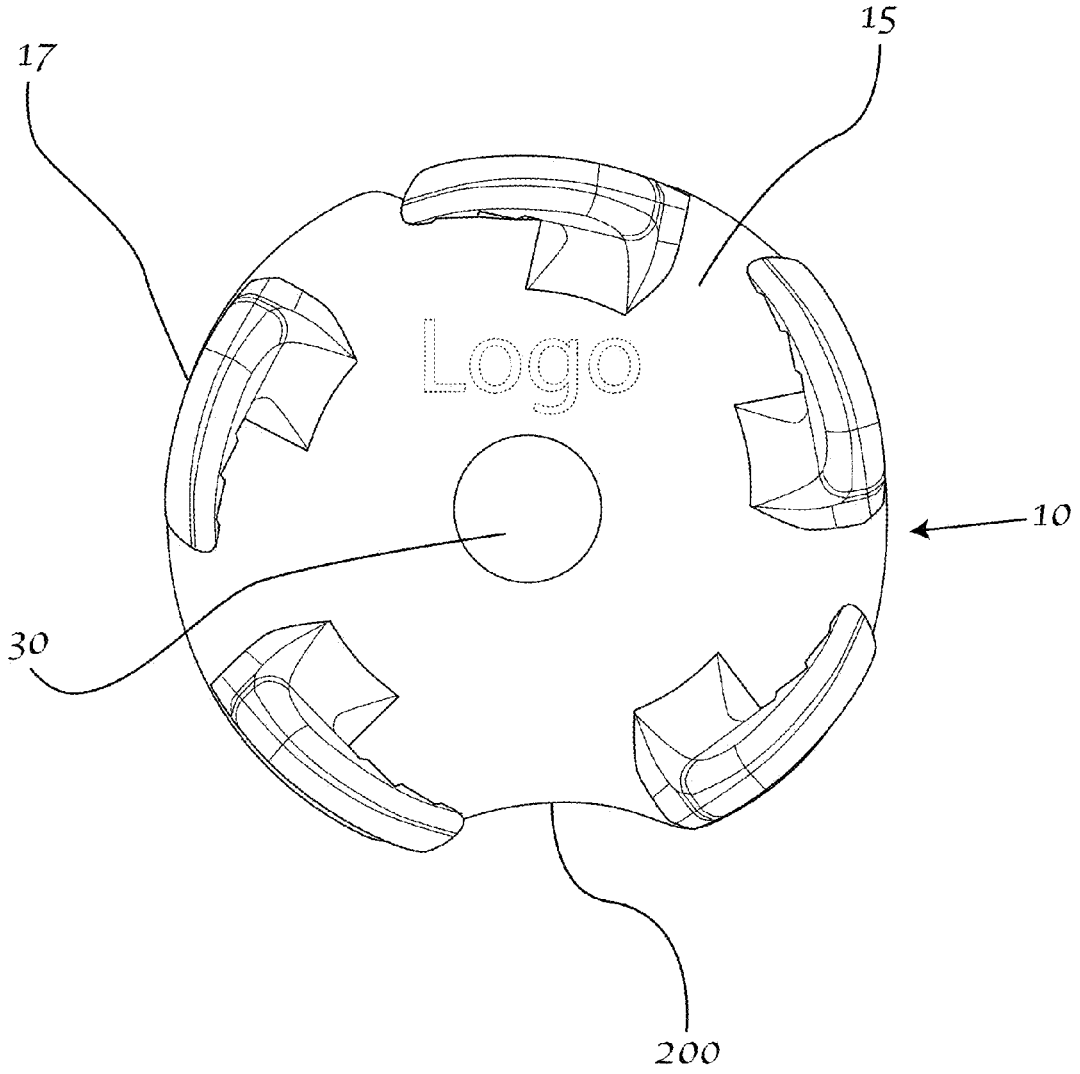
FIG. 8 is an illustration of a bottom view of another embodiment of the golf teeing device.

FIG. 8 is an illustration of a bottom view of another embodiment of the golf teeing device, showing five extensions. As shown in FIG. 8, the golf teeing device 10 preferably includes the base portion 15, extensions 17, grip notches 200, and hole 30.

Unless otherwise stated, all measurements, values, ratings, positions, magnitudes, sizes, locations, and other specifications that are set forth in this specification, including in the claims that follow, are approximate, not exact. They are intended to have a reasonable range that is consistent with the functions to which they relate and with what is customary in the art to which they pertain.

The foregoing description of the preferred embodiment of the invention has been presented for the purposes of illustration and description. While multiple embodiments are disclosed, still other embodiments of the present invention will become apparent to those skilled in the art from the above detailed description, which shows and describes illustrative embodiments of the invention. The invention is capable of modifications in various obvious aspects, all without departing from the spirit and scope of the present invention. Accordingly, the detailed description is to be regarded as illustrative in nature and not restrictive. Also, although not explicitly recited, one or more embodiments of the invention may be practiced in combination or conjunction with one another. Furthermore, the reference or non-reference to a particular embodiment of the invention shall not be interpreted to limit the scope of the invention. It is intended that the scope of the invention not be limited by this detailed description, but by the claims and the equivalents to the claims that are appended hereto.

Except as stated immediately above, nothing that has been stated or illustrated is intended or should be interpreted to cause a dedication of any component, step, feature, object, benefit, advantage, or equivalent, to the public, regardless of whether it is or is not recited in the claims.

What is claimed is:

1. A golf teeing device comprising:

a top portion; and a base portion;

wherein said base portion is comprised of two or more extensions;

wherein said two or more extensions are configured to removably and securely engage with a surface;

wherein said top portion is configured to cradle a golf ball;

wherein said two or more extensions are substantially located substantially near an outer rim of said base portion; and wherein said two or more extensions are substantially hooked-shaped, such that said two or more extensions first extend substantially downward away from said base portion and then extend substantially horizontal and substantially parallel to said base portion.

2. The golf teeing device of claim 1, further comprising:

a standard tee engagement portion, wherein said standard tee engagement portion is configured to matingly engage with a standard tee, such that said standard tee cradles a golf ball.

3. The golf teeing device of claim 2, wherein said standard tee engagement portion is comprised of a hole;

wherein an edge of said hole is configured to matingly engage with said standard tee, such that said standard tee cradles said golf ball.

4. The golf teeing device of claim 1, wherein said base portion further comprises one or more grip notches.

5. The golf teeing device of claim 1, wherein each of said two or more extensions are placed equidistant from each other along said outer rim of said base portion, is hooked in the same direction as each other, and is configured to engage with said surface by rotating said golf teeing device as said two or more extensions are in contact with said surface.

6. The golf teeing device of claim 5, wherein said two or more extensions are comprised of one or more serrated edges.

7. The golf teeing device of claim 6, wherein said hole is configured to matingly engage with a standard tee, such that a height of a golf ball placed on said standard tee is adjustable.

8. The golf teeing device of claim 7, wherein said surface is a golf mat.

9. The golf teeing device of claim 8, wherein said top portion is constructed of a soft plastic material.

10. The golf teeing device of claim 9, wherein said base portion is constructed of a hard plastic material.

11. The golf teeing device of claim 10, wherein said two or more extensions are six extensions.

12. A golf teeing device comprising:

a top portion;

a base portion; and a hole;

wherein said hole extends substantially through said top portion and said base portion;

wherein said hole is comprised of a raised lip edge on said top portion;

wherein said base portion is comprised of four or more extensions;

wherein said one or more extensions are configured to removably and securely engage with a surface;

wherein said raised lip edge is configured to cradle a golf ball;

wherein said four or more extensions are substantially located substantially near an outer rim of said base portion; and wherein said four or more extensions are substantially hooked-shaped, such that said four or more extensions first extend substantially downward away from said base portion and then extend substantially horizontal and substantially parallel to said base portion.

13. The golf teeing device of claim 12, wherein said hole is configured to matingly engage with a standard tee, such that said standard tee cradles said golf ball.

14. The golf teeing device of claim 13, wherein said base portion further comprises one or more grip notches.

15. The golf teeing device of claim 12, wherein each of said four or more extensions is placed equidistant from each other along said outer rim of said base portion, is hooked in the same direction as each other, and is configured to engage with said surface by rotating said golf teeing device as said four or more extensions are in contact with said surface.

16. The golf teeing device of claim 15, wherein said four or more extensions are comprised of one or more serrated edges.

17. The golf teeing device of claim 16, wherein said hole is configured to matingly engage with said standard tee, such that a height of a golf ball placed on said standard tee is adjustable.

18. The golf teeing device of claim 17, wherein said surface is a golf mat.

19. The golf teeing device of claim 18, wherein said top portion is constructed of a soft plastic material; and wherein said base portion is constructed of a hard plastic material.

20. A golf teeing device comprising:

a top portion;

a base portion; and a hole;

wherein said hole extends substantially through said top portion and said base portion;

wherein said hole is comprised of a raised lip edge on said top portion;

wherein said base portion is comprised of four or more extensions;

wherein said four or more extensions are configured to removably and securely engage with a surface;

wherein said raised lip edge is configured to cradle a golf ball;

wherein said hole is configured to matingly engage with a standard tee, such that said standard tee cradles said golf ball;

wherein said four or more extensions are located substantially near an outer rim of said base portion;

wherein said four or more extensions are substantially hooked-shaped, such that said two or more extensions first extend substantially downward away from said base portion and then extend substantially horizontal and substantially parallel to said base portion;

wherein said four or more extensions are placed equidistant from each other along said outer rim of said base portion, are hooked in the same direction as each other, and are configured to engage with said surface by rotating said golf teeing device as said four or more extensions are in contact with said surface;

wherein said four or more extensions are comprised of one or more serrated edges;

wherein said hole is configured to matingly engage with said standard tee, such that a height of a golf ball placed on said standard tee is adjustable;

wherein said top portion is comprised of a soft plastic material; and wherein said base portion is comprised of a hard plastic material.

* * * * *